US009179707B2

(12) United States Patent
Kaljura et al.

(10) Patent No.: US 9,179,707 B2
(45) Date of Patent: Nov. 10, 2015

(54) SMOKING ARTICLES AND METHODS OF MANUFACTURING SMOKING ARTICLES

(71) Applicant: BRITISH AMERICAN TOBACCO (INVESTMENTS) LIMITED, London (GB)

(72) Inventors: Karl Kaljura, London (GB); Ian Dunckley, London (GB); Philip Fawcus, London (GB); Stuart Dunlop, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 14/347,992

(22) PCT Filed: Sep. 26, 2012

(86) PCT No.: PCT/GB2012/052376

§ 371 (c)(1),
(2) Date: Mar. 27, 2014

(87) PCT Pub. No.: WO2013/045914

PCT Pub. Date: Apr. 4, 2013

(65) Prior Publication Data

US 2014/0230834 A1 Aug. 21, 2014

(30) Foreign Application Priority Data

Sep. 27, 2011 (GB) ..... 1116629.5

(51) Int. Cl.
*A24D 3/04* (2006.01)

(52) U.S. Cl.
CPC ..... *A24D 3/041* (2013.01); *A24D 3/043* (2013.01)

(58) Field of Classification Search
CPC ..... A24D 3/041; A24D 3/043
USPC ..... 131/280, 336, 338
See application file for complete search history.

(56) References Cited

U.S. PATENT DOCUMENTS

| | | | | |
|---|---|---|---|---|
| 2,954,035 | A | 9/1960 | Saffir | |
| 3,359,988 | A | 12/1967 | Thomson | |
| 3,376,874 | A | 4/1968 | Kim et al. | |
| 4,527,573 | A * | 7/1985 | Hausermann | 131/336 |
| 4,576,187 | A | 3/1986 | Deal | |
| 4,649,944 | A | 3/1987 | Houck, Jr. et al. | |

(Continued)

FOREIGN PATENT DOCUMENTS

| | | |
|---|---|---|
| EP | 0228211 A1 | 7/1987 |
| EP | 0260789 A1 | 3/1988 |

(Continued)

OTHER PUBLICATIONS

International Search Report and Written Opinion, mailed Jan. 31, 2013 for PCT/GB2012/052376, filed Sep. 26, 2012.
International Preliminary Report on Patentability, mailed Nov. 18, 2013, for PCT/GB2012/052376, filed Sep. 26, 2012.

*Primary Examiner* — Anthony Calandra
(74) *Attorney, Agent, or Firm* — N W Poulsen; L A Pinol

(57) ABSTRACT

A smoking article comprising a first part moveable relative to a second part, and defining an interface between the first and second parts located around the first part are provided, among other aspects. A cover is configured to cover the interface and obstruct ingress of air into the smoking article directly at the interface.

28 Claims, 6 Drawing Sheets

(56) References Cited

U.S. PATENT DOCUMENTS

| | | | | |
|---|---|---|---|---|
| 4,699,158 | A | 10/1987 | Sprinkel, Jr. | |
| 4,700,725 | A | 10/1987 | Geiszler, Jr. | |
| 4,834,117 | A * | 5/1989 | Braem et al. | 131/336 |
| 4,898,190 | A | 2/1990 | Deal | |
| 7,743,773 | B2 | 6/2010 | Gaworski | |

FOREIGN PATENT DOCUMENTS

| | | | |
|---|---|---|---|
| EP | 0664089 | A1 | 7/1995 |
| EP | 2033531 | A1 | 3/2009 |
| WO | 2011051115 | A1 | 5/2011 |

* cited by examiner

SMOKING ARTICLES AND METHODS OF MANUFACTURING SMOKING ARTICLES

CLAIM FOR PRIORITY

This application is the National Stage of International Application No. PCT/GB2012/052376, filed Sep. 26, 2012, which in turn claims priority to and benefit of British Patent Application No. GB1116629.5, filed Sep. 27, 2011. The entire contents of the aforementioned applications are herein expressly incorporated by reference.

The present disclosure relates to smoking articles, filter assemblies for smoking articles, and methods of manufacturing smoking articles.

U.S. Pat. No. 4,700,725 describes a variable dilution cigarette having relatively rotatable filter segments for controlling dilution. Tipping paper extends from substantially the mouth end of a filter plug to adjacent a tobacco rod end of the filter plug. The tipping paper is rotatable relative to the tobacco rod end of the filter plug. Air may leak into the smoking article through a gap between the tipping paper and tobacco rod end of the filter plug.

The present invention provides, in a first aspect, a smoking article comprising: a first part moveable relative to a second part, and defining an interface between the first and second parts located around the first part, and a cover configured to cover the interface and obstruct ingress of air into the smoking article directly at the interface.

The present invention provides, in a second aspect, a filter assembly for a smoking article, comprising: a first part including a first filter section moveable relative to a second part including a sleeve and a second filter section, and defining an interface between the first and second parts located around the first part, and a cover configured to cover the interface and obstruct ingress of air into the smoking article directly at the interface.

The present invention provides, in a third aspect, a method of manufacturing a smoking article comprising: attaching a first part to a second part such that the first part is moveable relative to the second part, and defines an interface between the first and second parts located around the first part, and attaching a cover around the first and second parts to cover the interface and obstruct ingress of air into the smoking article directly at the interface.

Various embodiments of the present invention(s) will now be disclosed, by way of non-limiting example only, with reference to the accompanying drawings, in which.

Figure 1:
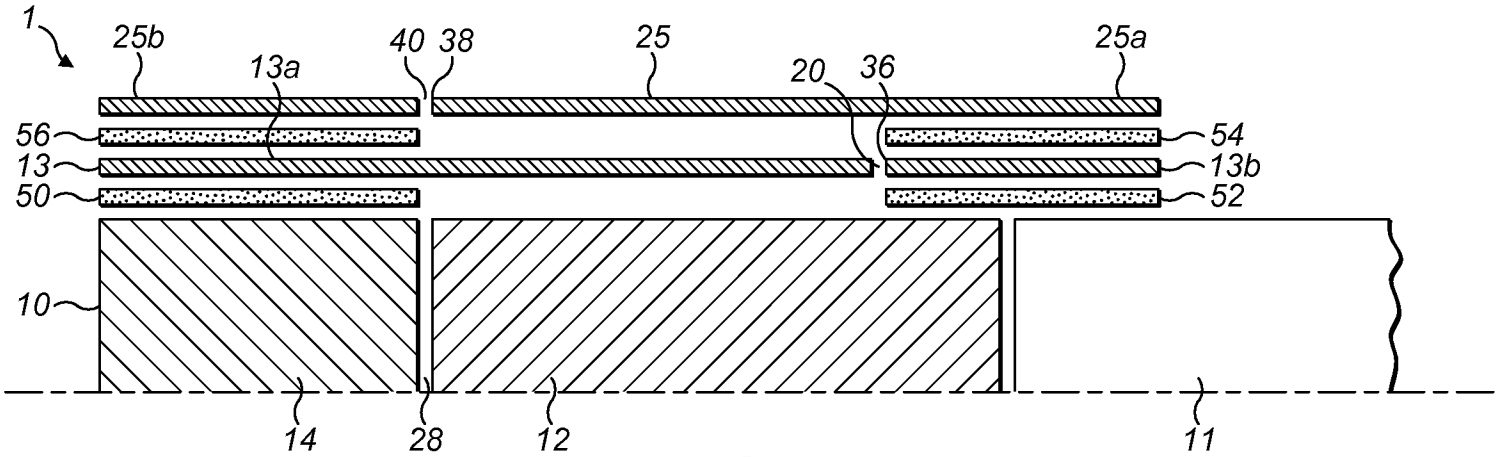
FIG. 1 is a schematic side elevation view of part of an exemplary smoking article in accordance with the present disclosure.
Figure 2:
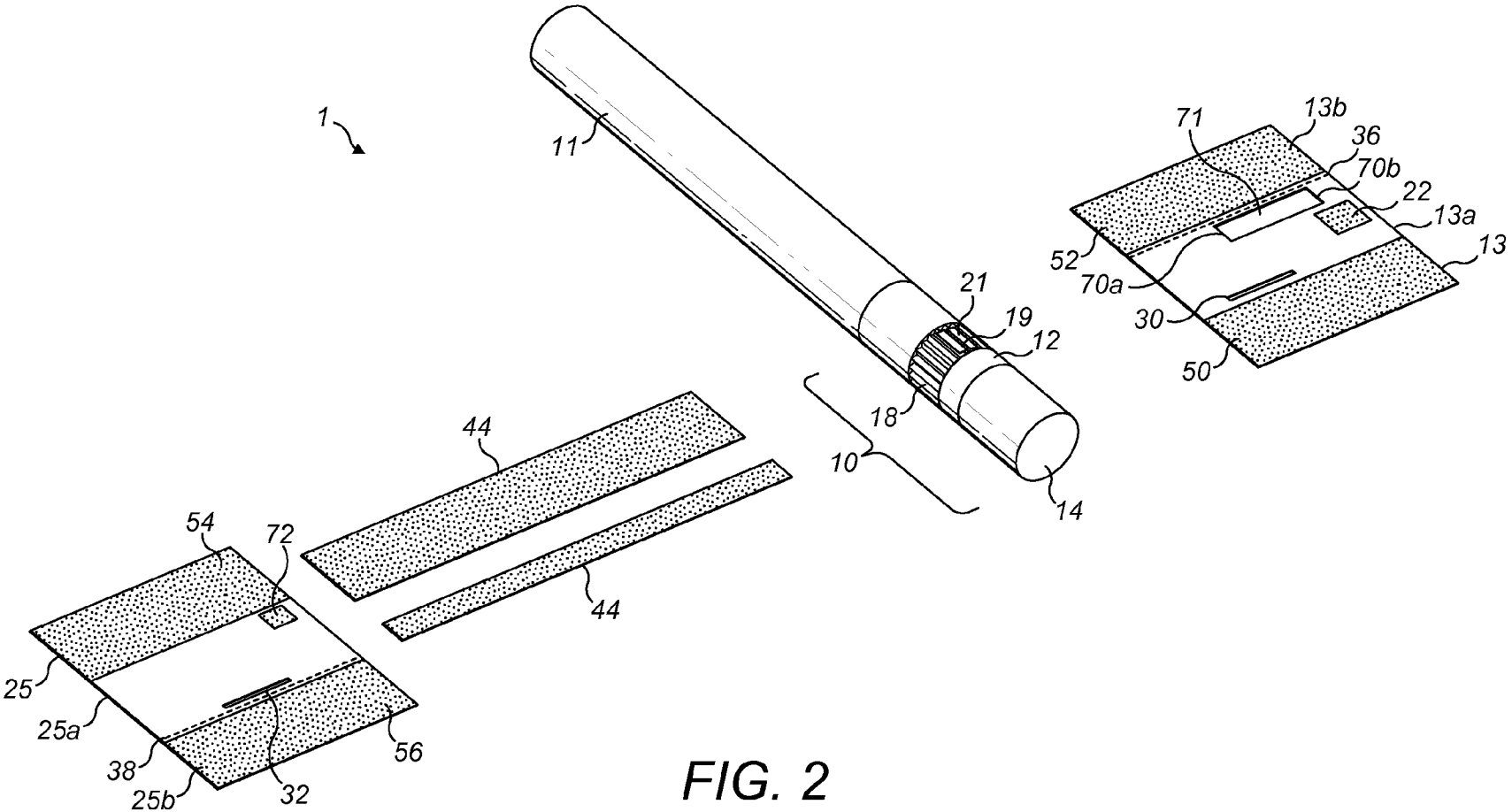
FIG. 2 is an exploded perspective view of an exemplary smoking article according to the present disclosure.

For purposes of illustration, and not limitation, FIGS. 1 and 2 show an example of a smoking article according to an embodiment of the present invention(s). The smoking article may be an article such as a cigarette, cigar or cigarillo, whether based on tobacco, tobacco derivatives, expanded tobacco, reconstituted tobacco or tobacco substitutes and also heat-not-burn products (i.e. products in which flavour is generated from a smoking material by the application of heat without causing combustion of the material). For convenience, these will be referred to as "smoking articles" in this specification.

FIGS. 1 and 2 show a smoking article 1. The smoking article 1 includes a first part comprising a source of smokable material 11, which is preferably tobacco. As illustrated, the source of smokable material 11 is in the form of a tobacco rod. The smoking article 1 further comprises a filter assembly 10 attached to the source of smokable material 11. The exemplary smoking article comprises a movable part, movable to select a ventilation level. In this example, the movement is a rotation. In some implementations, the smoking article may optionally comprise a limiter (limiting mechanism), configured to limit movement to a pre-determined range.

The filter assembly 10 may comprise a first filter section 12 and a second filter section 14. The first filter section 12 may be attached to the source of smokable material to form a single unit. The tobacco rod and first filter section 12 may be connected with a covering layer to affix the first filter section 12 to the tobacco rod, for example formed of sheet material, e.g. tipping paper, as is conventionally known. The tobacco rod and first filter section may be referred to as a first part of the smoking article, or as a tobacco unit. The elongate tobacco rod and first filter section define a longitudinal axis of the smoking article. A rearward direction may be defined towards a mouthpiece end of the smoking article, and a forward direction may be defined towards a tobacco, or lit, end of the smoking article.

A second part of the smoking article comprises the second filter section 14. The second filter section 14 is co-axial with the first filter section 12, and is located rearwardly of the first filter section 12.

The first and/or second filter sections 12,14 are preferably made of a conventional filtration material, e.g. cellulose acetate tow. The filtration material may be wrapped in a sheet material, preferably paper, e.g. plugwrap.

The second part of the smoking article further comprises a sleeve 13 in the form of a cylindrical tube extending around the circumference of the tobacco rod 11 and/or first filter section 12. The material of the sleeve 13 is substantially impermeable to air, and may be formed as a cylinder of sheet material, e.g. paper. The tobacco rod and first filter section are dimensioned to rotate as a unit around a longitudinal axis within the sleeve 13. The second filter section 14 is at a mouthpiece end of the sleeve 13, adjacent to the first filter section 12. The second filter section 14 is securely attached and fixed within the sleeve.

The first part has a first interface 20 with the second part. The interface 20 is located around the first part, i.e. the interface 20 is aligned with the first part. In particular, the interface 20 is defined between a forward end of the sleeve 13 and the adjacent exterior of the first part, e.g. first filter section 12 or tobacco rod 11. The interface is the external area at which the first and second parts meet, as viewed from outside of the sleeve 13. The first interface 20 may be a circumferentially extending gap between the sleeve 13 and the first part. Thus, the interface 20 may be defined as an external interface between the first part and the sleeve 13 (second part).

An internal interface 28 between the first and second parts may be defined as the adjacent areas of the first and second filter sections 12,14. The internal interface 28 may be spaced longitudinally from the first interface 20. The internal interface 28 may be located rearwardly of the first interface 20.

As depicted, the first interface 20 provides for movement of the second part around the first part. The first interface 20 may also allow leakage of air into the smoking article. Such leakage of air is generally not desirable or accurately controllable, and a smoking article according to some embodiments of the present invention is configured to reduce the amount of leakage of air through the first interface 20.

The smoking article 1 further comprises a cover 25. The cover 25 may be in the form of a cylindrical tube or sleeve, for example, formed of a sheet material such as paper. The cover 25 may, in some embodiments, be formed of a material which is substantially impermeable to air. The cover 25 extends over the first interface 20, substantially preventing air from entering the smoking article directly at the first interface 20. The cover 25 is located on an exterior of the first and second parts, and may be in close radial proximity to the first and second parts. In particular, the cover 25 extends longitudinally forwardly and rearwardly of the first interface 20, and extends around the whole circumference of the first interface 20.

The cover 25 may be attached to the first part of the smoking article. The cover 25 may be rotatable as a unit with the first part, and rotatable relative to the second part. Alternatively, the cover 25 may be freely rotatable, and not rigidly affixed to the first or second parts. The cover 25 will be described as separate to the first part of the smoking article, although when affixed to the first part, the cover 25 may be considered as a component of the first part of the smoking article.

In some embodiments, the material forming the sleeve 13 comprises a separation line 36, which extends substantially circumferentially. The material of the sleeve is configured to easily break along the separation line 36 into a rearward part 13*a* and a forward part 13*b*. The rearward part 13*a* is affixed to the second filter section 14, and is a component of the second part of the smoking article which is rotatable around the first part as described for the sleeve 13 above. The forward part 13*b* is affixed to the first filter section 12, for example, by adhesive. The forward part 13*b* may be considered as a component of the first part of the smoking article. Optionally, the forward part 13*b* of the sleeve 13 connects the tobacco rod 11 and first filter section 12. The separation line 36 may be defined by a plurality of perforations through the sheet material (e.g. paper) of the sleeve 13.

The rearward part 13*a* may be affixed to the second filter 14 by a first connection area 50. The first connection area 50 may extend over substantially the whole area of the rearward part 13*a* of the sleeve 13 and/or substantially the whole area of the second filter section 14. The forward part 13*b* may be affixed to the first filter 12 and/or tobacco rod 11 by a second connection area 52. The second connection area 52 may extend over substantially the whole area of the forward part 13*b* of the sleeve 13. The first and second connection areas 50,52 may comprise adhesive to permanently connect the forward and rearward parts of the sleeve to the underlying component(s) of the first and second parts. The rearward and forward parts 13*a*,13*b* of the sleeve 13 provide a uniform surface on which the cover 25 may be wrapped. The first connection area 50 may be adjacent and rearward of the internal interface, preventing air from travelling between the sleeve and exterior of the first part rearward of the internal interface. The second connection area 52 may be adjacent and forward of the first interface, preventing air from travelling between the sleeve and exterior of the first part forward of the first interface.

In some embodiments, the material forming the cover 25 may include a separation line 38, which extends substantially circumferentially. The material of the cover is configured to easily break along the separation line 38 into a forward part 25*a* and a rearward part 25*b*. The forward part 25*a* is affixed to the first part of the smoking article, and may be a component of the first part of the smoking article which is rotatable around the second part as described for the cover 25 above. The rearward part 25*b* is affixed to the second part of the smoking article, in particular, to an exterior of the sleeve 13 (rearward part 13*a* of the sleeve). The rearward part 25*b* may be considered as a component of the second part of the smoking article. The separation line 38 may be defined by a plurality of perforations through the sheet material (e.g. paper) of the cover 25. The forward part 25*a* may be affixed to the first part of the smoking article by a third connection area 54. In particular, the third connection area 54 may connect the forward part 25*a* of the cover 25 to the forward part 13*b* of the sleeve 13. The third connection area 54 may extend over substantially the whole area of the forward part 13*b* of the sleeve 13. The third connection area 54 may be adjacent and forward of the first interface, preventing air from travelling between the cover and sleeve forward of the first interface.

The rearward part 25*b* of the sleeve may be affixed to the sleeve 13 by a fourth connection area 56. The fourth connection area 56 may extend over substantially the whole area of the rearward part 25*b* of the cover 25. The first connection area 50 may be aligned with, and optionally extend over substantially the same area as, the fourth connection area 56. The second connection area 52 may be aligned with, and optionally extend over substantially the same area as, the third connection area 54. The fourth connection area 56 may be adjacent and rearward of the second interface, preventing air from travelling between the cover and sleeve rearward of the second interface.

The third and fourth connection areas 54,56 may include adhesive to permanently connect the forward and rearward parts of the cover to the underlying component(s) of the first and second parts. The forward and rearward parts 25*a*,25*b* of the cover 25 provide a uniform exterior surface of a rearward part of the smoking article.

As further illustrated, a rearward end of the cover 25 partially defines a second interface 40 into which air may leak. In particular, the second interface 40 may be formed at a rearward end of the cover 25, i.e. between the forward and rearward parts 25*a*,25*b* of the cover 25. The second interface 40 may be longitudinally spaced from the first interface 20 at an end of the sleeve 13. In addition, the first interface 20 may be longitudinally spaced from the internal interface 28. Optionally, the second interface 40 may be longitudinally aligned with the internal interface 28.

FIG. 2 shows the components forming the smoking article shown in FIG. 1. The smoking article may comprise a ventilation system configured to allow adjustment of a ventilation of the smoking article. The ventilation system may include one or more ventilation areas, which in turn include ventilation apertures and/or air permeable material, in one or each of the first part and second part. For example, when ventilation areas in the sleeve, cover and/or layers of sheet material around the first and/or second filter sections are aligned or overlap, air can flow into the body of the first and/or second filter section. The ventilation is selected by selecting a position of the second part relative to the first part to determine an amount of overlap of the ventilation areas.

The cover 25 may comprise one or more first ventilation areas 32. In some embodiments, the first ventilation area 32 is one or more apertures in the cover, for example, in the form of a narrow circumferential slit. The first ventilation area is elongate, in this example, in a circumferential direction. The first ventilation area may extend circumferentially over a part only of the circumference. The first ventilation area may extend at a single longitudinal position. The first ventilation area 32 allows ingress of air into the cover, for example, at or around the first or second filter sections.

The sleeve 13 may be provided with one or more second ventilation areas 30. The sleeve 13 may comprise one or more apertures in the sleeve, for example, a narrow circumferential slit or a plurality of discrete ventilation areas in a circumferentially extending area. The second ventilation aperture 30 may be at a single longitudinal position. The second ventilation area is elongate, in this example, in a circumferential direction.

The tobacco unit 11,12 may optionally comprise one or more third ventilation areas (not shown). In some embodiments, the third ventilation area is in the form of a plurality of discrete ventilation areas in a circumferentially extending area. The third ventilation area may have the same configuration as the first ventilation area. The third ventilation aperture allows ingress of air into the tobacco unit, for example, into the first filter section 12 and/or second filter section 14. The third ventilation area 34 may be one or more apertures or air permeable areas allowing air into the filtration material, through the layers of generally impermeable sheet material surrounding the filtration material. An overlap of the first, second and third ventilation areas allows ventilating air into the body of the smoking article, through the variable area of overlap. The first and third ventilation areas 32,34 are radially spaced and are fixed relative to each other. The second ventilation area 30, allowing air through the cover, is movable between the first and third ventilation areas 32,34 to control the ventilation of the smoking article.

Alternatively, ventilating air may enter into the second filter section 14 between the first filter section 12 and second filter section 14, i.e. through the internal interface 28. In this case, the whole of the exterior of the first filter section 12 may be substantially impermeable to air. Air entering through the first and second ventilation apertures 30, 32 may travel between the sleeve 13 and exterior of the first filter section 12 before entering the interface 28 and being drawn into the filtration material of the second filter section 14.

In some embodiments, the sleeve 13 and/or cover 25 comprises one or more further ventilation areas (not shown). The further ventilation area may provide ventilation which is independent of the rotational position of the position of the first and second parts of the smoking article. The further ventilation area may provide a base level, or minimum, ventilation to the smoking article. The further ventilation area may allow air through the sleeve, and into the second filter section 14. The second filter section 14 comprises filtration material surrounded by a porous paper wrap (e.g. plugwrap), which allows the ventilating air into the filtration material of the second filter section 14. The further ventilation area may comprise a plurality of apertures extending circumferentially in a line.

The position of the second part relative to the first part may be controlled by an indexer (indexing mechanism), configured to provide indexed rotation between a plurality of discrete positions. The indexing or control mechanism may optionally provide an audible sound indicating movement to or from the selected position. The indexing mechanism may require a force to move between indexing positions, providing tactile feedback to a user. The indexing mechanism may comprise a first indexing section (or surface) 18 on the tobacco unit, for example, on the first filter section 12. The first indexing section is engaged with a second indexing section (or surface) 19 on the sleeve 13. The indexing mechanism provides a number of indexed positions, such as at least three, preferably at least five or seven within a limited range of rotation, e.g. 90 or 120 degrees.

In an exemplary indexing mechanism, the first indexing section 18 has a plurality of depressions which are engageable by a protruding feature on the second indexing section. The depressions may form a corrugated exterior surface. The exterior surface comprises a plurality of elongate grooves, separated by ridges. In some examples, the grooves extend substantially longitudinally. The first indexing section 18 is formed on an exterior surface of a rod article of the smoking article, in particular, a filter section of the smoking article.

The second indexing section 19 may comprise one or more protrusions which are engageable with the first indexing section 18. The protrusion(s) may comprise one or more pawls, formed by one or more layers of sheet material which are folded to extend radially inwardly from the sleeve 13. The term "pawl" is intended to mean any type of protrusion which can engage with an indexing section to allow indexed movement in two directions. The upstanding pawl may be formed on a substrate 21, which may be a sheet material, for example, paper. The substrate 21 may be affixed to an interior surface of the sleeve 13, for example, by an adhesive area 22. The substrate may be folded to define the pawl as an upstanding ridge of sheet material, forming an edged peak. The pawl may have a substantially triangular cross-section. The indexing mechanism is separate and distinct from the limiting mechanism configured to limit the range of rotation between the first and second parts.

The smoking article may, in some embodiments, optionally comprise one or more spacers 44 adjacent to the pawl 19. The spacers 44 are configured to control the position (i.e. radial position) of the second indexing section relative to the first indexing section. In particular, the spacers 44 ensure a minimum radial position of the second indexing surface. The spacers 44 are configured to radially space an exterior surface of the tobacco unit from the part of the smoking article supporting or defining the second indexing section, i.e. the surrounding sleeve 13. In particular, the spacers 44 provide a radial position or space to assist the pawl 19 in disengaging from a groove of the first indexing section 18. The spacers 44 may be in the form of one or more layers of sheet material, e.g. paper, in particular, tipping paper. For example, the spacers may comprise a layer of sheet material extending around the circumference of the tobacco unit, forwardly and/or rearwardly of the first indexing section 18. The spacers 44 may extend circumferentially around a rod article of the smoking article on which the first indexing section is defined, in particular, filter section. The spacers may extend around the whole circumference of the rod article. A layer of sheet material forming a spacer 44 may optionally connect the first filter section 12 to the tobacco rod 11. The spacers 44 may also assist in ensuring the smoking article has a circular cross-section. The pawl 19 extends radially outwardly from the exterior surface of the first indexing section, so that rolling the sleeve 13 around the shape of only the first indexing section 18 and pawl 19 would give a non-circular shape. The spacers 44 extend radially outwardly from the exterior of the first indexing section by the same or greater distance than the extent of the pawl 19 radially outwardly from the exterior of the first indexing section. The spacers 44 provide a circular outer cross-section, around which the cover 13 can be rolled.

For example, the pawl 19 may have a radial extent of approximately 0.7 mm, and a groove of the first indexing section may have a radial extent of approximately 0.5 mm. The pawl 19 may extend approximately 0.2 mm beyond the exterior of the first indexing section, and so the spacers extend radially approximately 0.2 mm or more. These dimensions are examples only, and for example, any of these dimensions may be in a range of ±20% of the example dimensions.

The smoking article may optionally comprise a limiter (limiting mechanism) configured to limit rotation between the first and second parts. The limiting mechanism is configured to limit rotation to a pre-determined range. In some embodiments, the pre-determined range of rotation may be through an angle of from about 90 to 180 degrees, and may be, for example, about 120 degrees. The limiting mechanism may limit rotation between a position in which the first and second ventilation areas have no overlap, and a further position in which the first and second ventilation areas are in full overlap. The limiting mechanism may comprise engaging parts on the sleeve 13 cover 25, which is attached to the first part of the smoking article. Thus, the limiting mechanism is configured to limit movement between the first and second parts to a predetermined range, which may be by limiting movement between the cover and second part.

The limiting mechanism comprises a first contact surface 70*a* and a second contact surface 70*b*. The first contact surface 70*a* and second contact surface 70*b* are configured to engage with a stop 72 to limit the range of movement in a first and second direction respectively. The first and second contact surfaces 70*a*, 70*b* may be the opposite ends of a window 71.

The limiting mechanism, or limiter, may comprise the stop 72 attached to one or more of the cover, first part and second part (sleeve), and a window 71 on another of the cover, first part and second part (sleeve 13). The stop 72 may be moveable within the window 71 to limit movement between the first and second parts. The first contact surface 70*a* and a second contact surface 70*b* may be circumferentially spaced, i.e. the window 71 may extend circumferentially and have circumferential ends defining the first and second contact surfaces 70*a*, 70*b*, such that the limiting mechanism limits a rotation between the first and second parts. The stop 72 and first and second contact surfaces 70*a*, 70*b* may have engaging edges which are complementary, i.e. match to engage simultaneously across their width. For example, the first and second contact surfaces 70*a*, 70*b* and engaging edges of the stop 72 may extend perpendicularly to the axis of the window 71, i.e. parallel to the axis of the smoking article. The stop 72 may have a square or rectangular area.

In the example shown, the window 71 may be in the form of an aperture extending circumferentially through the sheet material of the sleeve 13, for example, overlying the first filter section 12.

The stop 72 may be affixed to an interior of the cover 25. The stop 72 may form a protrusion, extending radially into the window 71. The stop 72 may be formed by adhesive, forming a raised protrusion. Alternatively, the stop 72 may extend radially outwardly from the tobacco unit, into the window 71.

In an alternative arrangement, the stop 72 may extend through the window 71 in the sleeve 13, and attach to both radially adjacent layers, i.e. to both the cover 25 and the tobacco unit (first part). The cover 25 and tobacco unit form a single unit, between which the sleeve 13 is rotatable. The stop 72 provides a connection between the cover 25 and the tobacco unit. The stop 72 may be formed only of adhesive, adhered to both the cover 25 and the tobacco unit. The attachment of the stop 72 to both radially adjacent layers means that the stop 72 cannot be moved out of the window 71, for example, by a radial deformation of the sleeve 13 defining the window 71.

Figure 3:
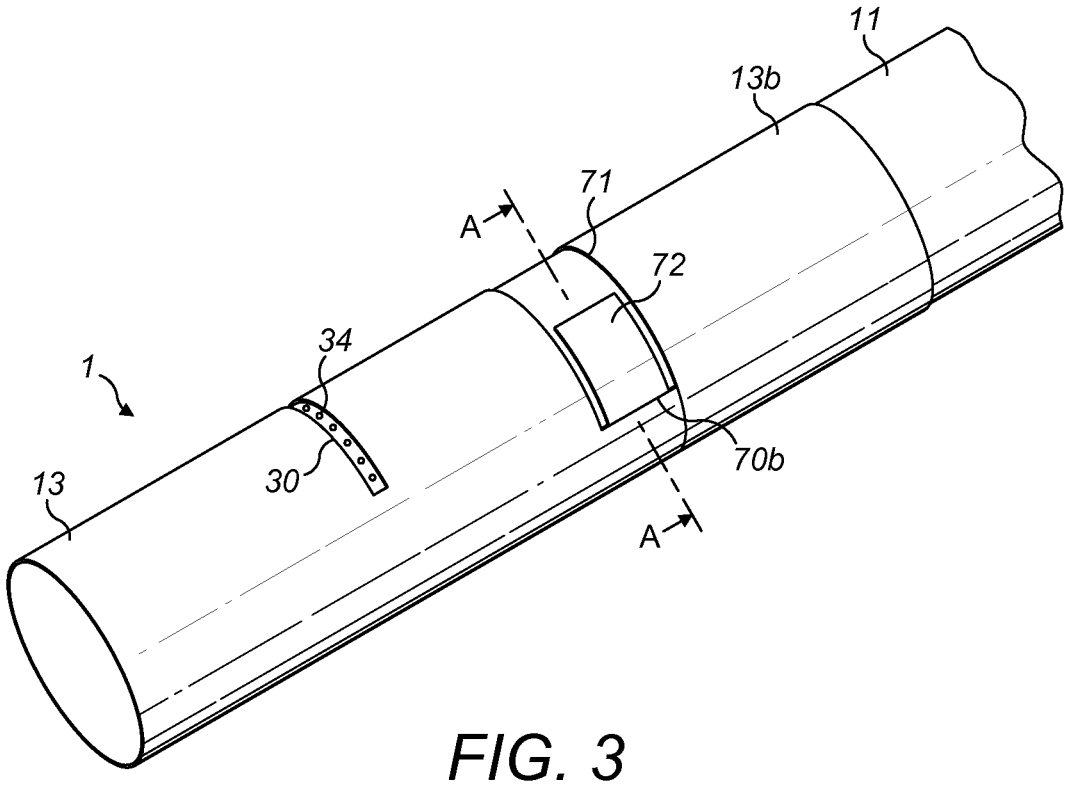
FIG. 3 is a perspective view of a part of an exemplary smoking article according to the present disclosure.

FIG. 3 shows a perspective view of a smoking article 1, without the cover 25 shown. The stop 72 is configured to engage with the edge 70*b* of the window 71, as described above. The window 71 may be partially defined by the frangible connection line 36, which may form a forward circumferential border of the window 71.

The sleeve 13 may be provided with a single second ventilation area 30, in the form of a single elongate slot. The first part comprises one or more third ventilation areas 34, which may be in the form of a plurality of discrete ventilation areas, for example, apertures. The third ventilation areas 34 may be arranged in a row at a single longitudinal position, to be selectively aligned with the second ventilation area 30. The third ventilation areas 34 may be located to allow ventilation air into the first filter section 12. The third ventilation areas 34 may be laser drilled holes. An exterior of the first filter section 12 may be formed of an air impermeable material, for example, impermeable paper or a laminate of paper and cellulose acetate. The exterior of the first filter section 12 is relatively rigid, to form a first indexing section as described below. The apertures 34 in the exterior of the first filter section 12, which may extend through the spacers 44, allow ventilation air into the body of filtration material.

Figure 4:
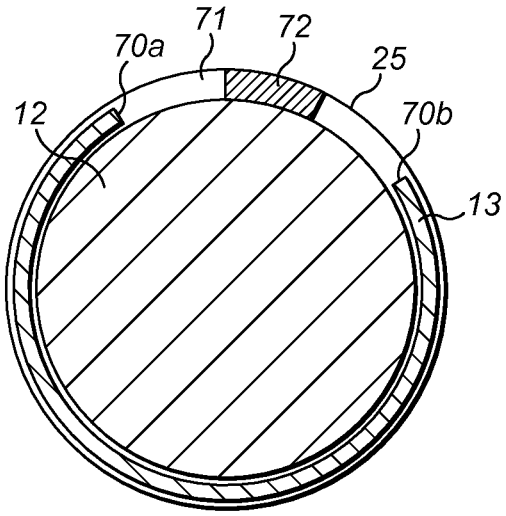
FIG. 4 is a lateral cross-section through the smoking article to the present disclosure, along the line A-A shown in FIG. 3.

FIG. 4 shows a cross-section through the smoking article along line A-A shown in FIG. 3, illustrating the limiting mechanism. The sleeve 13 defines the window 71. The stop 72 may be attached to one or both of a filter section (e.g. first filter section 12) and/or cover 25. In this example, the stop 72 is attached to both the first filter section 12 and cover 25. According to some embodiments, the stop 72 is preferably formed at least in part of, and more preferably formed entirely of adhesive, which extends between, and adheres to both of, the first filter section 12 and cover 25.

Figure 5:
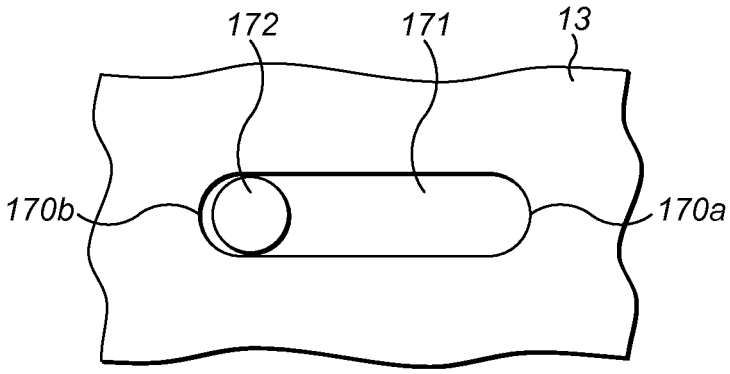
FIG. 5 is a schematic plan view of an alternative embodiment of part of the smoking article according to the present disclosure.

FIG. 5 shows an alternative configuration of the limiter (limiting mechanism). The window 171 is formed with curved edges forming the first and second contact surfaces 170*a*, 170*b*. The curved edges are concave facing the window. Stop 172 may be formed with edges which are complementary to the first and second contact surfaces 170*a*, 170*b*. For example, the stop 172 may be formed with a circular area. Alternatively, the stop 172 may be elongate with curved edges. The rounded edges of the window 171 may make the material of the sleeve 13 less likely to tear adjacent to the window. The further features and operation of the limiting mechanism is the same as described above, with equivalently named features having the same function as described.

Figure 6:
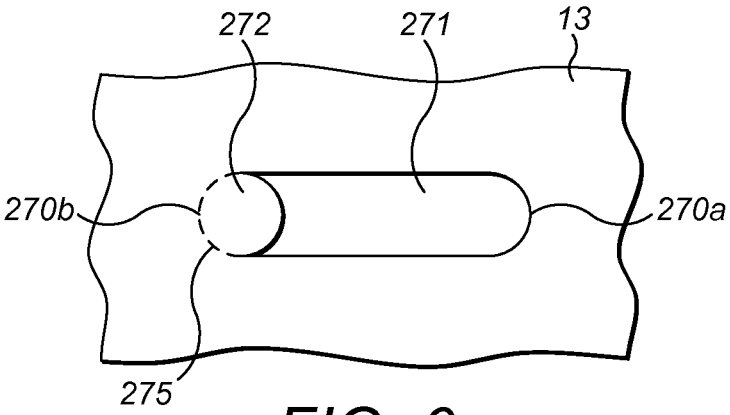
FIG. 6 is a further alternative embodiment of part of an exemplary smoking article according to the present disclosure.

FIG. 6 shows a further alternative embodiment of the limiter (limiting mechanism) in which at least part of stop 272 may be initially formed as a part of one of the second part, first part or cover. In particular, at least part of stop 272 is initially formed as part of, i.e. integrally formed with, the sleeve 13. The area of sheet material of the sleeve 13 for forming the stop 272 may be separable from the remainder of the sleeve along a separation line 275, for example, by perforations formed in the material of the sleeve 13. The window 271 may be formed adjacent the area of sheet material for forming the stop 272, in the same one of the second part, first part or cover in which the stop 272 is formed. The area of sheet material of the sleeve for forming the stop may be affixed to one or more adjacent layers, in particular, to one or both of the cover 25 or tobacco unit. For example, the stop 272 may be affixed to the adjacent layer(s) by adhesive. The stop 272 is formed from the same layer of material as the window and first and second contact surfaces, i.e. the same one of the second part, cover or first part. On an initial movement between the first and second parts, the area of sheet material of the sleeve 13 for forming the stop 272 is urged towards the window 271, separating that area of sheet material from the remainder of the sleeve, and forming a distinct movable stop 272.

The first contact surface 270*a* is initially formed as an edge of the window 271. The second contact surface 270*b* is defined by the separation line 275. The stop 272 may be formed with edges which are complementary to the first and second contact surfaces 270*a*, 270*b*, for example, curved edges as shown. The stop 272 comprises the area of sheet material forming the sleeve 13, and optionally also the affixing means (e.g. adhesive) connecting the sheet material to the cover 25 or tobacco unit. The stop 272 is then movable in the window, and remains attached to one or both of the cover 25 or tobacco unit. The further features and operation of the limiting mechanism is the same as described above, with equivalently named features having the same function as described.

Figure 7:
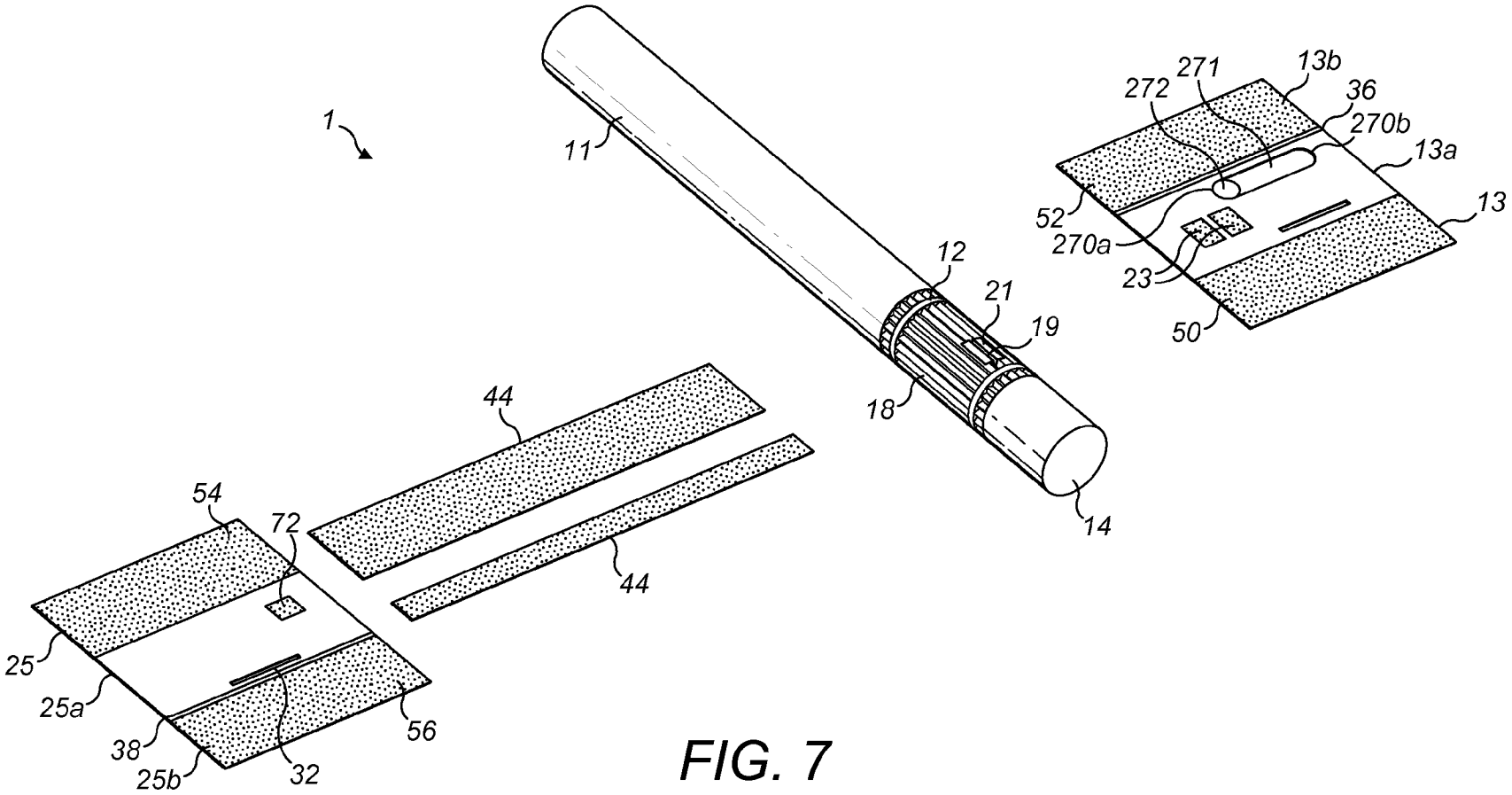
FIG. 7 is an exploded perspective view of the smoking article of FIG. 6.

FIG. 7 shows an exploded view of the smoking article 1 including the limiting mechanism described with respect to FIG. 6. The stop 272 is located in the plane of the sleeve 13, within window 271. The first and second contact surfaces 270*a*, 270*b* are shown as curved, although may be straight or have any configuration. An adhesive patch 72 on the cover 25 is arranged to adhere to the stop 272, connecting the stop to the cover 25. The stop 272 may optionally also be affixed to the first part, e.g. to the first filter 12.

The indexing mechanism may comprise an upstanding pawl integrally formed with a substrate 21, which may be a sheet material, for example, paper. The substrate 21 may be affixed to an interior surface of the sleeve 13, for example, by one or more adhesive areas 23. In this example, the substrate 21 is affixed to the sleeve 13 with two adhesive areas 23, which are spaced apart. The two adhesive areas 23 are configured to connect the sleeve either side of the pawl 19, but not apply adhesive directly onto the area of the pawl 19. The embodiment of FIG. 7 may comprise one or more spacers, having the same function and/or arrangement as described with respect to spacers 44 in FIG. 2.

Alternatively, the first and second contact surfaces 70*a*, 70*b* may not be formed by a window. The first and second contact surfaces 70*a*, 70*b* may be formed by strips of sheet material extending longitudinal and affixed to or integrally formed with one of the sleeve, cover or first part.

The smoking article may be configured to restrain the sleeve 13 from moving longitudinally over the tobacco unit. For example, the grooves, and optionally ridges, of the first indexing section 18 may have a radius which is less than forwardly and rearwardly adjacent parts of the first part. The second indexing section 19 is configured to engage with the forwardly and rearwardly adjacent parts, such that the second indexing section is retained longitudinally within the first indexing section. The first indexing section may have a longitudinal extent which is substantially the same as the second indexing section to prevent relative longitudinal movement between the first and second parts. Alternatively, the sleeve 13 may be restrained from moving longitudinally by the rotational limiting mechanism. In particular, stop 72 engaged in window 71 may substantially prevent longitudinal movement.

The first and/or second filter section may comprise an adsorbent additive. In some examples, the adsorbent additive may be carbon, for example, charcoal and in particular, activated carbon. Alternatively, the adsorbent additive may be a resin. The resin may be an ion exchange resin with a polyamine group as chelating ligand bonded onto a cross-linked polystyrene matrix, for example, Diaion® CR20. In some embodiments, the adsorbent additive may be distributed within the filtration material of the first filter section 12. The adsorbent additive may be substantially uniformly distributed in the filtration material. The adsorbent additive may be granules of carbon.

Figure 8:
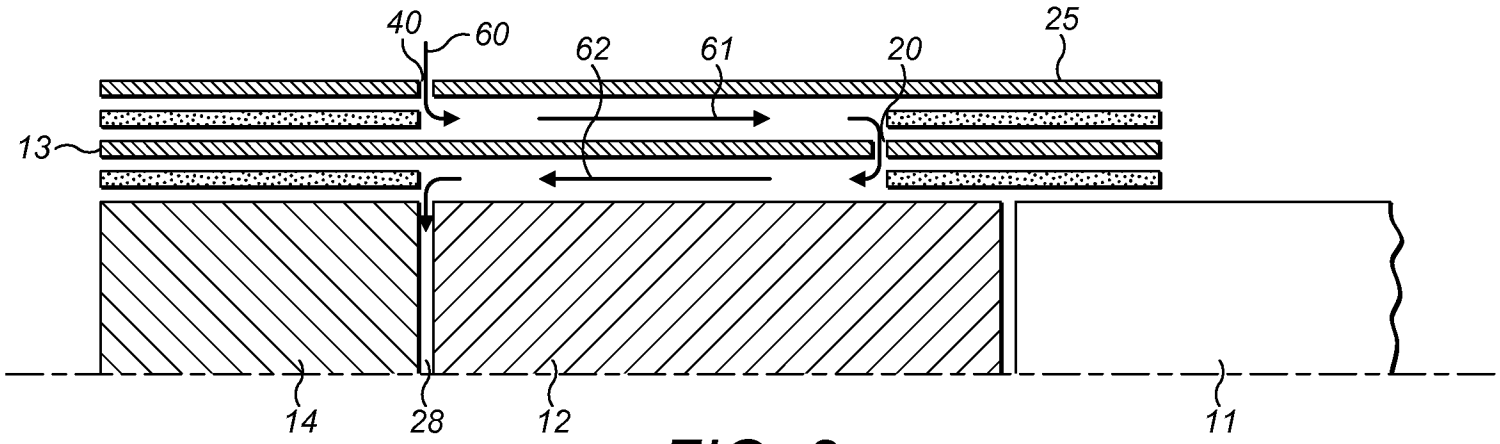
FIG. 8 is a schematic side elevation view of part of an exemplary smoking article in accordance with the present disclosure.

FIG. 8 shows a leakage pathway 60 into the smoking article according to embodiments of the present invention(s). An outermost interface between the first and second parts is the second interface 40. Air entering at the interface 40 is restricted to travel with a component in a first longitudinal direction, i.e. forwardly towards the first interface 20, along path 61. The first interface 20 and second interface 40 may be longitudinally spaced. The flow of air is restricted by the cover 25 and sleeve 13, which are both formed of air impermeable material. The flow of air 61 is forced to travel forwardly until interface 20 at a forward end of the sleeve 13.

Air entering at the first interface 20 is restricted to travel with a component in a second longitudinal direction, i.e. rearwardly towards the internal interface 28, along path 62. The second longitudinal direction is opposite to the first longitudinal direction. The first interface 20 and internal interface 28 are longitudinally spaced. The flow of air is restricted by the sleeve 13 and exterior of the first part, i.e. first filter 12, which may both be formed of air impermeable material. The flow of air 62 may be forced to travel rearwardly until internal interface 28 at a rearward end of the first filter section 12.

The cover 25 extending over the first interface 20 ensures that air leaking into the smoking article at an interface between the first and second parts cannot directly enter at the first interface 20. Instead, the cover 25 forces leakage air to follow a tortuous path, which may include at least one change in direction. Thus, the cover 25 reduces the amount of air leaking into the smoking article during use.

In use, the forward and rearward parts of the sleeve 13 and the forward and rearward parts of the cover 25 may initially be connected. The smoking article may optionally have a defined initial ventilation, set by the further ventilation area, and a pre-determined initial alignment of the first and second ventilation areas 30,32. The sleeve is not readily rotatable (or slidable) relative to the tobacco unit. Application of a rotational force to the rearward part 25*b* of the cover, relative to the tobacco unit (or forward part 25*a* of the cover), breaks the cover 25 along the separation line 38 and the sleeve 13 along the separation line 36. The second part is then rotatable to vary the ventilation by alignment of the first and second ventilation areas. For example, the second part may be held by the rearward part 25*b* of the cover 25, and rotated relative to the forward part 25*a* of the cover.

An exemplary method of manufacturing the smoking article 1 is now described. The first filter section 12 may be formed with an exterior surface defining the first indexing section. An adhesive is applied to the blank(s) of sheet material for forming the spacers 44 and/or to the first filter section 12, and the blank(s) of sheet material may then be wrapped around the first filter section 12 to form the spacers 44. Ventilation apertures 34 may be formed through the spacers 44 and material forming an exterior of the first filter section. The substrate 21 with the pawl 19 may be located on the first indexing section.

A blank of sheet material for forming the sleeve 13 is prepared by forming a window 71; 171; 271 and ventilation area 30. Optionally, the sleeve 13 may be processed (perforated) to form frangible connections 275 for the limiter, and/or frangible connection 36. The ventilation area 30, window and/or frangible connection(s) may be formed prior to attachment of the sleeve. An adhesive is applied to the blank of sheet material for forming the sleeve 13 and/or to the first filter section, substrate 21 and/or optionally the tobacco rod.

The first filter section 12 is aligned with the second filter section 14 (i.e. with their longitudinal axes aligned). Optionally, the tobacco rod 11 is also aligned with the first filter section 12. The blank of sheet material for forming the sleeve is wrapped around the first and second filter sections 12,14, and optionally also around the tobacco rod 11. The adhesive is applied on specific areas to connect the sleeve 13 to the second filter section 14, substrate 21, and optionally the first filter section and/or tobacco rod.

A blank of sheet material for forming the cover 25 is prepared by forming a ventilation area 32. Optionally, the cover 25 may be processed (perforated) to form frangible connection 38. The ventilation area 32 and/or frangible connection may be formed prior to attachment of the cover. An adhesive is applied to the blank of sheet material for forming the cover 25 and/or first filter section, and optionally the tobacco rod and/or sleeve 13. Adhesive is also applied to the cover 25 to form the stop 72 or connect to the stop 172;272, or additionally or alternatively, adhesive may be applied to the first indexing section to form the stop, or applied to stop 172;272 to attach to the cover.

The blank of sheet material for forming the cover 25 is wrapped around the sleeve 13 surrounding at least the first filter section 12, and optionally also the second filter section 14 and/or the tobacco rod 11. The adhesive is applied on specific areas to connect the cover 25 to the first filter section (by attaching to the overlying part of the sleeve 13), and optionally to the second filter section 14 (by attaching to the overlying part of the sleeve 13), and optionally the tobacco rod. The components of the smoking article may be affixed to (or wrapped around) the first filter section in the order of: the spacers 44, the sleeve 13, and then the cover 25. At least one of the cover 25, sleeve 13, spacer 44 or a separate layer of sheet material is wrapped around, and adhered to, both the first filter section 12 and tobacco rod, to connect the first filter section 12 and tobacco rod.

The present invention may be defined as a filter assembly, comprising the components of the smoking article without the tobacco rod 11. In particular, the assembly may comprise the first and second filter sections, sleeve and cover as described above.

The cover 25 has been described as having a rearward part 25*b* forming a component of the second part of the smoking article. Alternatively, in some embodiments, the cover 25 may not have a rearward part, and may only comprise the forward part 25*a*. Rotation may be obtained by rotating a rearward end of the sleeve 13 (rearwardly of the cover 25) relative to the cover 25. The second interface 40 may be defined between an edge of the cover 25 and the underlying sleeve 13. The sleeve 13 may not comprise a forward part, and may only comprise rearward part 13*a*.

The forward part 13*b* of the sleeve 13 has been described as connecting the tobacco rod 11 and first filter section 12. In an alternative embodiment, the first filter section 12 and tobacco rod 11 are not connected by a part of the sleeve 13. The sleeve 13 may comprise a frangible connected part 13*b* attached only to the first filter section 12, or alternatively, the sleeve may not comprise a frangibly connected part 13*b*. The sleeve 13 does not extend forwardly beyond the first filter section 12. Instead, the first filter section 12 and tobacco rod 11 may be connected by a part of the cover 25, in particular, forward part 25*a*. Alternatively, the first filter section 12 and tobacco rod 11 may be connected by a separate strip of sheet material circumscribing and adhered to the first filter section 12 and tobacco rod 11. The attachment of the first filter section 12 and tobacco rod 11 by a part other than the sleeve 13 may improve manufacturing of the smoking articles. In particular, the sleeve 13 may need to be accurately aligned with the pawl 21, or to ensure the parts of the limiter are accurately aligned with the first filter section and/or cover. The use of a part other than the sleeve 13 to connect the first filter section 12 and tobacco rod 11 provides a separation of the processes of assembling the smoking article, since the connection of the first filter section 12 and tobacco rod 11 can be carried out in a separate step to the attachment of the sleeve to other components. Thus, alignment of the sleeve 13 with other components may be simpler or improved.

The movement limiter has been illustrated as being formed by a window in the sleeve of the second part. Alternatively, the window may be on the cover, and engageable by a protruding stop on the sleeve. Alternatively, the first and second contact surfaces 70*a*, 70*b* may be on the first part, i.e. on the tobacco unit. The first and second contact surfaces 70*a*, 70*b* may be defined by opposite ends of a recess, or as raised steps, e.g. formed by strips of sheet material. The window or recess may be adjacent to an area of material for forming the stop, which is frangibly attached to the remainder of the first part, second part or cover.

The second ventilation area has been described as rotatable relative to a first ventilation area to control a ventilation level. In some embodiments, the second ventilation area may additionally or alternatively be slidable longitudinally relative to a first ventilation area to control a ventilation level. The relative longitudinal movement of the first and second parts is parallel to the longitudinal axis of the smoking article. Any of the embodiments described may be equally applicable to a longitudinal movement and position. The longitudinal movement of the two parts may be a telescopic movement with the sleeve of the second part slidable around an exterior of the first part, and within the cover. The extendable smoking article may optionally comprise a limiting means to limit extension and/or an indexing means to provide indexed positions.

The indexing mechanism has been described as acting between the tobacco unit and the sleeve. Alternatively, an indexing mechanism may act between the sleeve and the cover, with the cover attached to the first part of the smoking article.

The smoking article has been described as having a first filter section and a second filter section. One or both of the first filter section and a second filter section may comprise a single segment of filtration material, or may comprise two or more segments of filtration material joined together. Each segment may comprise filtration material wrapped in a separate paper wrap. The sections or segments of filtration material may have different properties, for example, the presence or absence of adsorbent additive.

The indexer has been described as separate and distinct from the limiter configured to limit the range of rotation between the first and second parts. Alternatively, the indexer and limiter may be integrally formed. In particular, the substrate 21 may define a pawl 19 engaging with the first indexing section 18. The substrate 21 may be located within stops to limit the range of rotation. For example, the stops may be affixed to the first indexing section. In some aspects, the stops may be formed by a layer of sheet material extending around a part only of the circumference of the first indexing section, defining radially extending ends within which the substrate is located, and against which the substrate 21 is engagable to limit rotation.

Embodiments of the invention(s) have been described in this disclosure as features of a smoking article. Alternatively, the features described may be provided on a filter assembly for a smoking article or a component of a smoking article.

Embodiments of the present invention show locations for adhesive for connecting two components. The adhesive may be applied to one of the components as shown, or may alternatively or additionally be applied to the other of the components. The locations of the adhesive are merely exemplary, and different configurations of attachment, achieving the same or similar functions, may also be used.

Any of the features of any embodiment may be combined with any of the features of any other embodiment.

Embodiments of the invention are configured to comply with applicable laws and/or regulations, such as, by way of non-limiting example, regulations relating to yields, constituents, testing, and/or the like. For example, an embodiment of the invention may be configured such that a smoking article implementing the invention is compliant with applicable regulations before and after adjustment by a user. Such implementations may be configured to be compliant with applicable regulations in all user-selectable positions. In some embodiments, the configuration is such that a smoking article implementing the invention meets or exceeds required regulatory test(s) in all user-selectable positions, such as, by way of non-limiting example, the testing threshold(s)/ceiling(s) for cigarette yields and/or smoke constituents.

Many other modifications and variations will be evident to those skilled in the art, that fall within the scope of the following claims.

The invention claimed is:

1. A smoking article comprising:

a first part defining a longitudinal axis, said first part being moveable relative to a second part comprising a sleeve, the sleeve surrounding at least a portion of the first part, the first part and the second part defining an interface therebetween, the interface disposed circumferentially around the first part and at an end of the sleeve, and a cover disposed around the interface and configured to obstruct direct ingress of air into the smoking article at the interface;

wherein the smoking article is configured to substantially prevent the sleeve from moving longitudinally over the first part.

2. The smoking article as claimed in claim 1 wherein a position of the first part relative to the second part determines a ventilation of the smoking article.

3. The smoking article as claimed in claim 1, wherein the cover is attached to the first part, and moveable with the first part relative to the second part.

4. The smoking article as claimed in claim 1, wherein the cover comprises a further sleeve extending around an exterior of the first part and an exterior of the second part.

5. The smoking article as claimed in claim 1, wherein the interface between the first part and the second part is a first interface, and further comprising a second interface defined on an exterior of the smoking article between the cover and the second part, wherein the first interface is longitudinally spaced from the second interface.

6. The smoking article as claimed in claim 5, wherein the second interface is rearwardly of the first interface.

7. The smoking article as claimed in claim 1, wherein the smoking article defines an air pathway with a component in a first longitudinal direction to a first interface between the first and second parts from a second interface on an external surface of the smoking article, and with a component in a second, opposite, longitudinal direction away from the first interface.

8. The smoking article as claimed in claim 1, wherein the cover has a rearward end which is substantially longitudinally aligned with a rearward end of the first part.

9. The smoking article as claimed in claim 1, further comprising a limiter, the limiter configured to limit movement between the first part and the second part to a predetermined range.

10. The smoking article as claimed in claim 9 wherein the cover is attached to the first part, and the limiter is configured to limit movement between the cover and the second part.

11. The smoking article as claimed in claim 9, wherein the limiter comprises a stop on one of the first part, the cover and the second part, and a first contact surface and a second contact surface on another of the first part, the cover and the second part, wherein the stop is engageable with the first contact surface and the second contact surface to limit movement.

12. The smoking article as claimed in claim 9, wherein the limiter comprises:

a window in the second part, the window defining a first contact surface and a second contact surface, and a stop engageable with the first contact surface and the second contact surface to limit movement, wherein the stop is attached to the first part and to the cover.

13. The smoking article as claimed in claim 12, wherein material forming at least a part of the stop is initially frangibly connected to one of the second part, the cover and the first part, and attached to at least one of another of the second part, the cover and the first part, and configured to break at the frangible connection with an initial movement and allow movement of the stop between the first contact surface and the second contact surface.

14. The smoking article as claimed in claim 13, wherein the second part comprises a further sleeve having a window, wherein material forming at least a part of the stop is initially frangibly connected to the further sleeve and adjacent to the window of the second part, wherein the stop is attached to at least one of the first part and the cover.

15. The smoking article as claimed in claim 9, wherein a window defines the first contact surface and the second contact surface, and wherein at least one of the first contact surface and the second contact surface is curved.

16. The smoking article as claimed in claim 1, wherein the first part includes a first filter, and the second part includes a second filter, wherein the first filter and the second filter are adjacent and define an internal interface, and the sleeve is attached to the second filter and extends around the first filter, wherein the end of the sleeve defines a first interface between the first part and the second part, wherein the first interface is longitudinally spaced from the internal interface, and wherein the cover comprises a further sleeve attached to the first part and extending over the first interface.

17. The smoking article as claimed in claim 1, further comprising an indexer configured to provide indexed movement between the first part and the second part.

18. The smoking article as claimed in claim 17, wherein the indexer engages between the sleeve of the second part and a body of the first part, and wherein the sleeve of the second part surrounds the body of the first part.

19. The smoking article as claimed in claim 17, further comprising at least one spacer configured to control a position of a second indexing section of the indexer on the second part relative to a first indexing section of the indexer on the first part.

20. The smoking article as claimed in claim 19, wherein the at least one spacer extends circumferentially around a rod article defining the first indexing surface, at least one of forwardly and rearwardly of the first indexing section.

21. A filter assembly for a smoking article, comprising:

a first part including a first filter section moveable relative to a second part including a sleeve and a second filter section, the sleeve surrounding at least a portion of the first part, the first part and the second part defining an interface therebetween, the interface disposed circumferentially around the first part and at an end of the sleeve, and a cover disposed around the interface and configured to obstruct direct ingress of air into the filter assembly at the interface, wherein the first part defines a longitudinal axis of the filter assembly, the filter assembly configured to substantially prevent the sleeve from moving longitudinally over the first part.

22. A method of manufacturing a smoking article comprising:

attaching a first part defining a longitudinal axis of the smoking article to a second part comprising a filter section and a sleeve, such that the first part is moveable relative to the second part, the sleeve surrounds at least a portion of the first part, and the first part and the second part define an interface therebetween, the interface disposed circumferentially around the first part and at an end of the sleeve, attaching a cover around the first part and the second part to cover the interface and obstruct direct ingress of air into the smoking article at the interface; and forming the smoking article to substantially prevent the sleeve from moving longitudinally over the first part.

23. The method as claimed in claim 22, further comprising attaching the cover to the first part, such that the cover is moveable with the first part relative to the second part.

24. The method as claimed in claim 22, wherein at least one of:

attaching the first part comprises attaching the sleeve of the second part, including wrapping a blank of sheet material around at least a portion of an exterior of the first part to form the sleeve, and the cover comprises a further sleeve, and attaching the cover comprises wrapping a sheet material around the exterior of the first part and an exterior of the second part to form the cover.

25. The method as claimed in claim 22, further comprising forming a limiter configured to limit movement between the first part and the second part to a predetermined range.

26. The method as claimed in claim 25 wherein forming the limiter comprises:

forming a window in the second part, the window defining a first contact surface and a second contact surface, and forming a stop engagable with the first contact surface and the second contact surface to limit movement, and attaching the stop to the first part and to the cover.

27. The method as claimed in claim 26, wherein forming the stop comprises forming a frangible connection in material for forming one of the second part, the cover and the first part, and wherein the frangible connection is configured to break upon an initial movement, and allow movement of the stop between the first contact surface and the second contact surface.

28. The method as claimed in claim 25, wherein the forming a limiter comprises forming a stop on one of the first part, the cover and the second part, and a first contact surface and a second contact surface on another of the first part, cover, and second part, wherein the stop is engagable with the first contact surface and the second contact surface to limit movement.

* * * * *